US009669458B2

(12) United States Patent
Weber et al.

(10) Patent No.: US 9,669,458 B2
(45) Date of Patent: Jun. 6, 2017

(54) MICRO CHANNEL AND METHODS OF MANUFACTURING A MICRO CHANNEL

(71) Applicant: General Electric Company, Schenectady, NY (US)

(72) Inventors: David Wayne Weber, Simpsonville, SC (US); Gregory Thomas Foster, Greer, SC (US); Benjamin Paul Lacy, Greer, SC (US); Aaron Ezekiel Smith, Simpsonville, SC (US); Dustin Michael Earnhardt, Greenville, SC (US)

(73) Assignee: General Electric Company, Schenectady, NY (US)

( * ) Notice: Subject to any disclaimer, the term of this patent is extended or adjusted under 35 U.S.C. 154(b) by 653 days.

(21) Appl. No.: 14/173,949

(22) Filed: Feb. 6, 2014

(65) Prior Publication Data

US 2015/0218962 A1 Aug. 6, 2015

(51) Int. Cl.

| | |
|---|---|
| ***B22C 7/02*** | (2006.01) |
| ***B22C 9/24*** | (2006.01) |
| ***B22C 9/04*** | (2006.01) |
| ***B22C 9/10*** | (2006.01) |
| ***F01D 5/18*** | (2006.01) |

(52) U.S. Cl.

CPC ..... *B22C 7/02* (2013.01); *B22C 9/04* (2013.01); *B22C 9/10* (2013.01); *B22C 9/103* (2013.01); *B22C 9/108* (2013.01); *B22C 9/24* (2013.01); *F01D 5/186* (2013.01); *F05D 2230/211* (2013.01); *F05D 2240/81* (2013.01); *F05D 2260/204* (2013.01)

(58) Field of Classification Search

CPC .... B22C 7/02; B22C 9/04; B22C 9/10; B22C 9/103; B22C 9/108; B22C 9/24; F01D 5/186

See application file for complete search history.

(56) References Cited

U.S. PATENT DOCUMENTS

| | | | | |
|---|---|---|---|---|
| 5,317,805 | A * | 6/1994 | Hoopman | B23P 15/26 257/E23.098 |
| 5,653,110 | A * | 8/1997 | Lee | F01D 5/186 416/95 |
| 7,311,497 | B2 | 12/2007 | Sharma et al. | |
| 7,371,049 | B2 | 5/2008 | Cunha et al. | |
| 7,731,481 | B2 | 6/2010 | Cunha et al. | |
| 8,042,268 | B2 * | 10/2011 | Arrell | B21D 53/78 164/34 |
| 2011/0132564 | A1 * | 6/2011 | Merrill | B22C 7/02 164/30 |
| 2016/0177782 | A1 * | 6/2016 | Hough | F01D 5/187 415/115 |

* cited by examiner

*Primary Examiner* — Richard Edgar

(74) *Attorney, Agent, or Firm* — Armstrong Teasdale LLP

(57) ABSTRACT

A core for forming micro channels within a turbine component is provided. The core includes a base comprising a first side and a second side; and a core assembly coupled to the second side. The core assembly further includes a plurality of channel members, wherein each channel member has a first end, a second end, and a channel body coupled to and extending between said first end and said second end. The channel body includes a channel shape configured to form the micro channels within the turbine component.

20 Claims, 10 Drawing Sheets

MICRO CHANNEL AND METHODS OF MANUFACTURING A MICRO CHANNEL

BACKGROUND OF THE INVENTION

The embodiments described herein relate generally to turbine component s, and more particularly, to methods and systems for forming a micro channel in a turbine component.

In a gas turbine, hot gases flow along an annular hot gas path. Typically, turbine stages are spaced along the hot gas path such that the hot gases flow past buckets and nozzles forming the turbine stages. Conventionally, turbine buckets and nozzles may include an airfoil that extends radially outwardly from a substantially planar platform. A hollow hook portion extends radially inwardly from the planar platform and may include a dovetail or other means to secure the bucket to a turbine wheel. In general, during operation of the gas turbine, the hot gases are generally directed past the airfoil. To protect the airfoil and endwalls from high temperatures, the airfoil may include a cooling circuit that circulates a cooling medium, such as air, within the airfoil. Other turbine component s may be similarly cooled.

The cooling circuit may include a series of micro channels defined within the airfoil or any other hot gas path or combustion component. The micro channels enable the cooling medium flowing through the cooling circuit to be channeled close to the surface of the heated components, such as, but not limited to, airfoils, endwalls, and combustion linings. More particularly, after casting the airfoil, the micro channels are typically machined into surface to be in flow communication with the airfoil cooling circuit. Some processes to form the micro channels include drilling processes, electrical discharge machining processes, and/or abrasive water jet processes. Such, machining processes, however, may add significant costs to manufacturing the airfoil. Moreover, it may be difficult to access portions of the airfoil that are between adjacent airfoils using conventional machining processes. Still further, the conventional airfoil may require a supply plenum and/or a discharge plenum in flow communication with the micro channels to be also machined. Machining a supply plenum and/or a discharge plenum may add significant costs to manufacturing the airfoil and create tolerance issues of coupling the supply plenum and/or the discharge plenum in flow communication with the micro channels.

BRIEF DESCRIPTION OF THE INVENTION

A core for forming micro channels within a turbine component is provided. The core includes a base comprising a first side and a second side; and a core assembly coupled to the second side. The core assembly further includes a plurality of channel members, wherein each channel member has a first end, a second end, and a channel body coupled to and extending between said first end and said second end. The channel body includes a channel shape configured to form the micro channels within the turbine component.

In another aspect, a casting assembly for forming a micro channel within a turbine component is provided. The casting assembly includes a core having a base that includes a first side and a second side; and a core assembly coupled to the second side. The core assembly includes at least one plenum member having a plenum shape and at least one channel member coupled to the at least one plenum member and having a channel shape. A wax tool is coupled to the base. The wax tool includes a mold portion coupled to the first side and a wax cavity coupled to the mold portion and configured to inject a quantity of wax against the base, the at least one plenum member, and the at least one channel member.

In yet another aspect, a method of manufacturing a micro channel within a turbine component is provided. The method includes coupling a core to a wax tool, the core having a first plenum member, a second plenum member, and at least one channel member coupled to and extending between the first plenum member and the second plenum member. The method further includes applying a quantity of wax from the wax tool and against the core, the first plenum member, the second plenum member, and the at least one channel member. An investment casting process is performed on the core to form a first plenum, a second plenum, and at least one micro channel into the applied wax.

Still further, in another aspect, a method of manufacturing a micro channel within a turbine component is provided. The method includes providing a core having a first plenum member, a second plenum member, and at least one channel member coupled to and extending between the first plenum member and the second plenum member; heating the first plenum member, the second plenum member, and the at least one micro channel member; and moving the heated first plenum member, the heated second plenum member, and the at least one heated channel into the amount of wax. The method further includes forming a first plenum, a second plenum, and a micro channel.

DETAILED DESCRIPTION OF THE INVENTION

The embodiments described herein relate generally to micro channels. More particularly, the embodiments relate to methods and systems for use in forming a micro channel within a turbine component. It should be understood that the embodiments described herein are not limited to turbine airfoils, and further understood that the description and figures that utilize a turbine, an airfoil and a micro channel are exemplary only. Moreover, while the embodiments illustrate the turbine airfoil, the embodiments described herein may be included in other suitable turbine component s such as, but not limited to, turbine nozzles, stator vanes, compressor blades, platforms, endwalls, combustion liners, transition pieces, and exhaust nozzles. Additionally, it should be understood that the embodiments described herein are not limited to turbine component s. Rather, the micro channels described herein may be used in any suitable component through which a medium such as, water, steam, air, fuel and/or any other suitable fluid is directed for cooling the component and/or for maintaining a temperature of the component.

Figure 1:
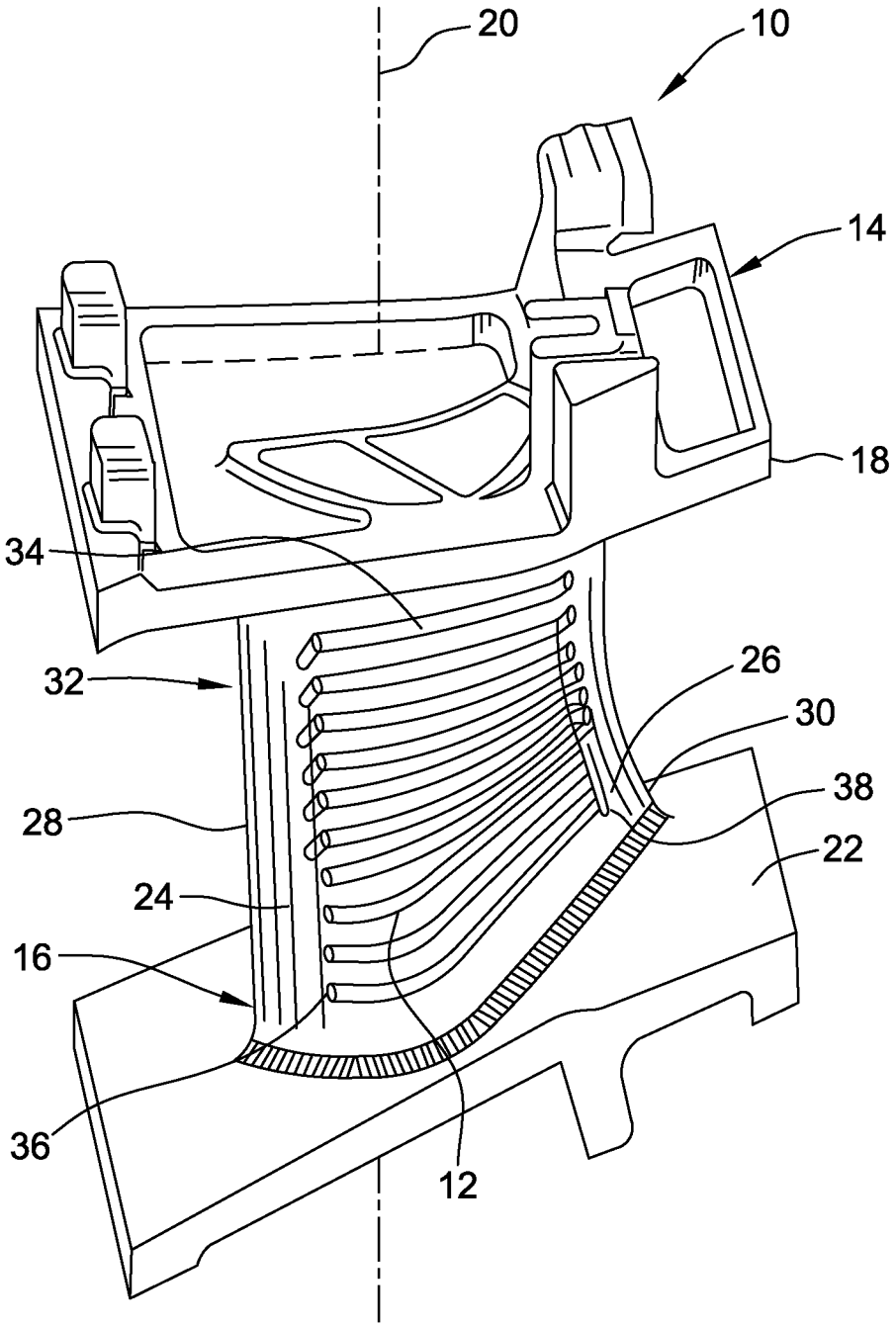
FIG. 1 is a perspective view of an exemplary turbine component having a plurality of micro channels.
Figure 2:
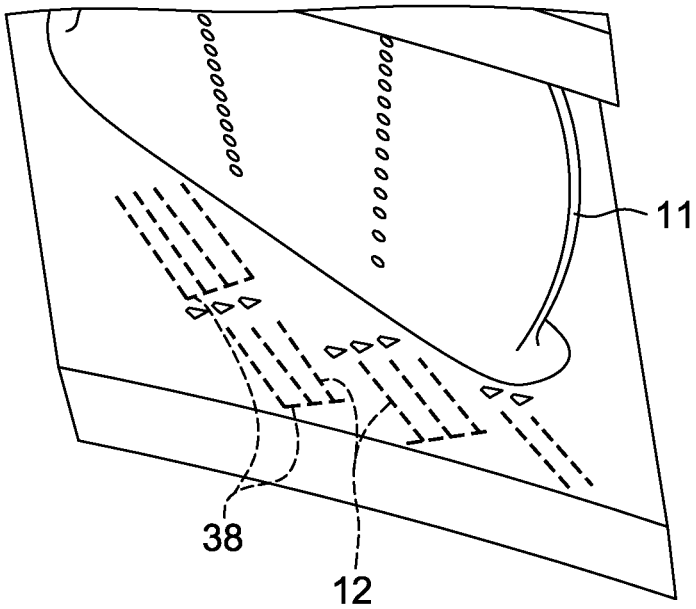
FIG. 2 is a partial cut-away view of another exemplary turbine component having a plurality of micro channels.

FIG. 1 is a perspective view of a turbine component 10 having a plurality of micro channels 12. FIG. 2 is a partial cut-away view of a turbine component 10 having the plurality of micro channels 12. In the exemplary embodiment shown in FIG. 1, turbine component 10 includes a hook portion 14 and an airfoil 16 extending from a substantially planar platform 18. Hook portion 14 secures component 10 to a gas turbine (not shown). Platform 18 forms a radially inward boundary for hot gases of combustion flowing through a turbine section (not shown) of a gas turbine (not shown). In the exemplary embodiment, airfoil 16 extends outwardly generally along a radial axis 20 from platform 18 and includes an airfoil base 22 positioned at platform 18. Airfoil 16 includes a pressure side surface 24 and an opposite suction side surface 26 that each extend between a leading edge 28 and a trailing edge 30.

In the exemplary embodiment, turbine component 10 includes an airfoil cooling circuit 32 that extends within airfoil 16 to enable a medium 34, for example a cooling fluid such as, but not limited to, air, water, fuel, steam and/or any other suitable fluid, to be channeled through and/or within airfoil 16. In the exemplary embodiment, airfoil circuit 32 includes the plurality of micro channels 12 that extends axially from one or more inlet passages 36 to one or more outlet passages 38 of airfoil 16. Inlet passages 36 may be individually coupled in flow communication to airfoil 16 or may be coupled in flow communication to a common trough or plenum (not shown). Outlet passages 38 may be individually coupled in flow communication to airfoil 16 or may be coupled in flow communication to a common trough or plenum (not shown).

Figure 3:
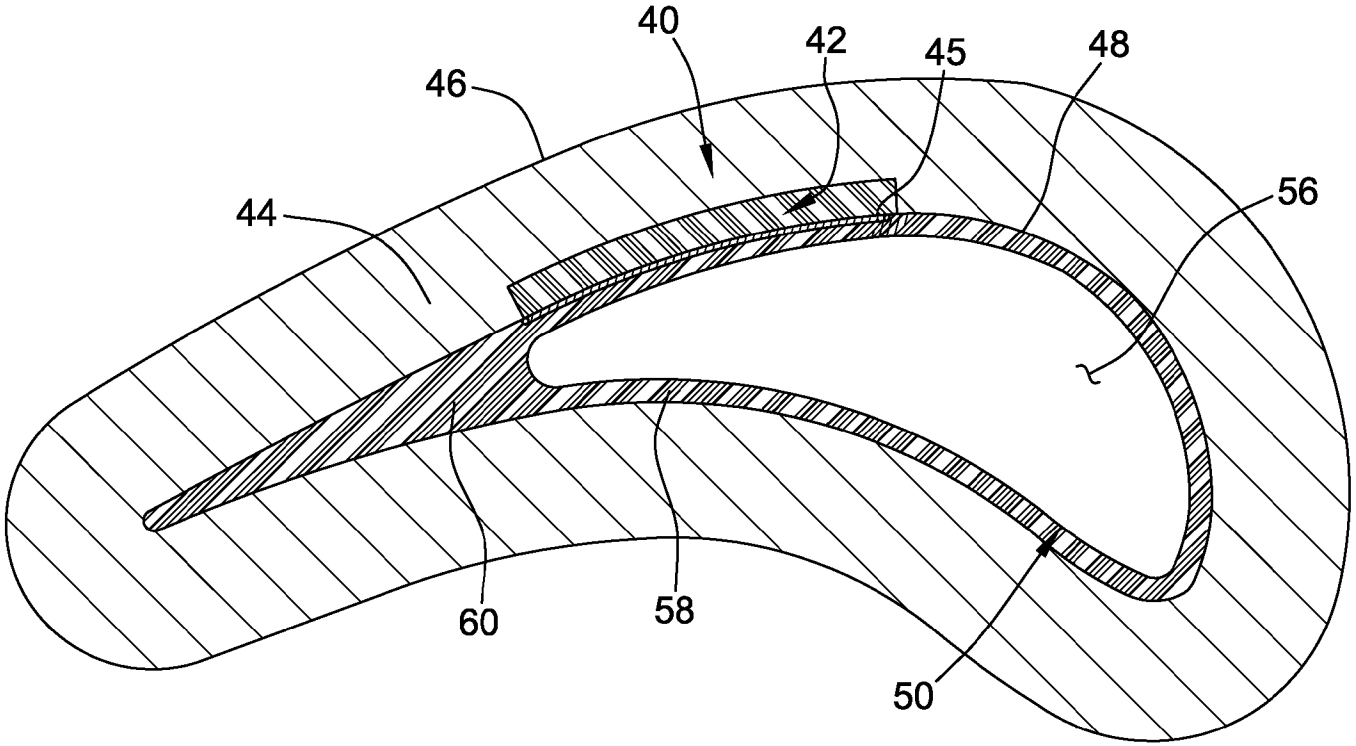
FIG. 3 is a cross-sectional view of an exemplary wax tool and core used to form the micro channels shown in FIG. 1 and/or shown in FIG. 2.

FIG. 3 is a cross sectional view of a wax tool 40 and a core 42 coupled thereto. Wax tool 40 and core 42 are configured to form micro channels 146 (shown in FIG. 9) in turbine component 10 (shown in FIG. 1) by a process such as, but not limited to, an investment casting process as described herein. Wax tool 40 includes a mold portion 44 having an outer surface 46 and an inner surface 48. In the exemplary embodiment, inner surface 48 of wax mold portion 44 and outer surface 52 of cavity portion 50 are configured to define a wax cavity 58. Wax cavity 58 is configured to contain an amount of wax 60 which is applied against core 42 during the investment casting process.

Figure 4:
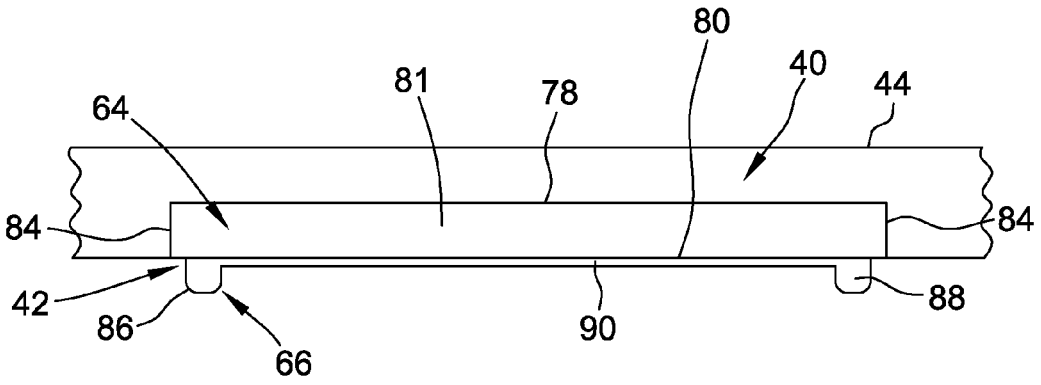
FIG. 4 is a front elevational view of the wax tool and core shown in FIG. 3.
Figure 5:
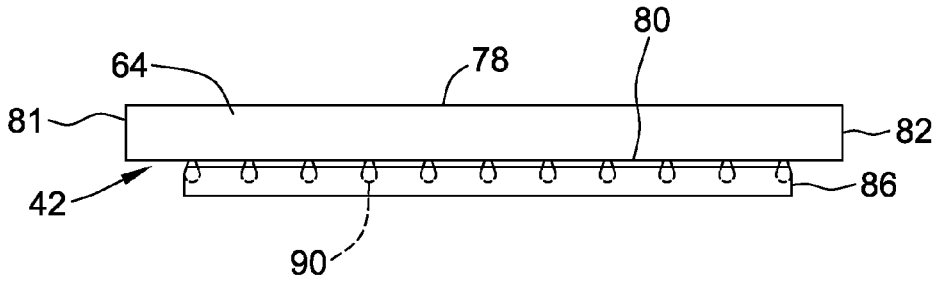
FIG. 5 is a side elevational view of the core shown in FIG. 3.
Figure 6:
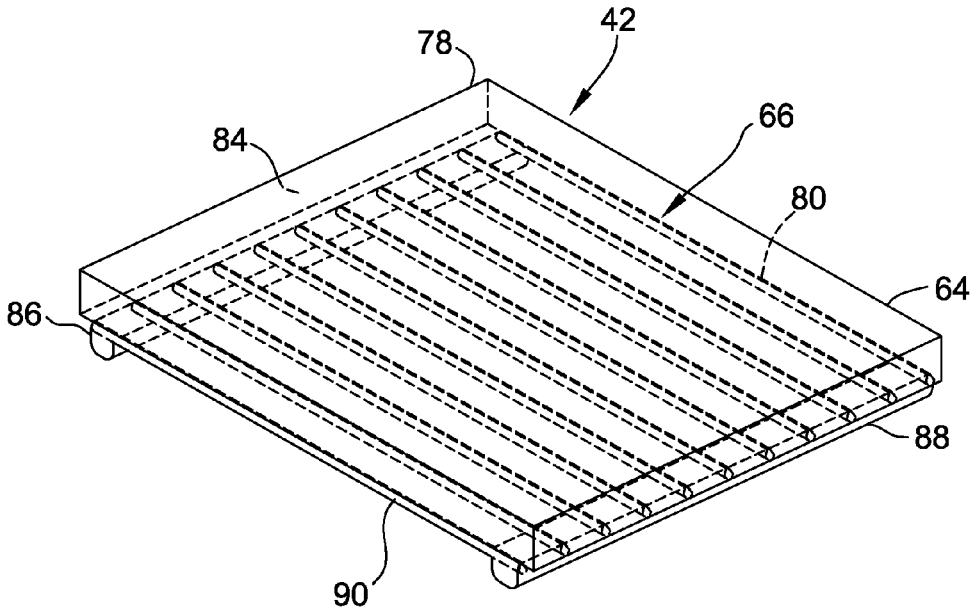
FIG. 6 is a perspective view of the core shown in FIG. 3.

FIG. 4 is a front elevational view of the wax tool 40 and core 42 shown in FIG. 3. FIG. 5 is a side elevational view of core 42 shown in FIG. 3. FIG. 6 is a perspective view of core 42 shown in FIG. 3. Core 42 is formed from a plurality of materials such as, but not limited to, ceramic materials, metallic materials, refractory materials, and alloy materials. Core 42 includes a base 64 and a core assembly 66. Base 64 is coupled to mold portion 44 and core assembly 66 is coupled to base 64. Core assembly 66 includes a first plenum member 86 and a second plenum member 88. Alternatively, core assembly 66 may include a single plenum member or more than two plenum members. Moreover, core assembly 66 includes a plurality of channel members 90 coupled to and extending between first and second plenum members 86 and 88. In an alternative embodiment, core assembly 66 may only include a single channel member 90. Core assembly 66 may include any configuration and number of channel members and/or plenum members to enable core assembly 66 to function as described herein. Moreover, alternatively, assembly 66 may not include any plenum member and/or core assembly 66 may include discrete inlet and/or outlet members (not shown) coupled to each micro channel 146 (shown in FIG. 8). Additionally, at least one of first plenum member 86 and second plenum member 88 may include discrete inlet and/or outlet members (not shown).

Base 64 includes a top side 78, a bottom side 80, a first side 81, a second side 82, and a plurality of side walls 84. Top side 78 and bottom side 80 are coupled to and extending between first and second sides 81 and 82. In the exemplary embodiment, top side 78, bottom side 80, first side 81, second side 82, and side walls 84 cooperate to define a square configuration. In the exemplary embodiment, top side 78 couples to wax tool 40 (shown in FIGS. 3 and 4). Alternatively, base 64 may have any configuration that enables core 42 to couple to wax tool 40. In the exemplary embodiment, core assembly 66 is coupled to base 64. In the exemplary embodiment, core assembly 66 is integrally coupled to base 64 as a one-piece configuration. Alternatively, core assembly 66 may be removably coupled to base 64. More particularly, the plurality of channel members 90 are coupled to bottom side 80 and extend away from bottom side 80. Plenum members 86 and 88 couple to channel members 90 and extend away from channel members 90 to facilitate forming micro channels 146 (shown in FIG. 9) for efficient, cost effective, and convenient cooling flow. Alternatively, plenum members 86 and 88 can couple to bottom side 80 and extend away from bottom side 80. In one embodiment, channel members 90 extend into plenum member 86 and plenum member 88 to facilitate forming micro channels 146 (shown in FIG. 9) in flow communication with at least one plenum 143 and plenum 144 (shown in FIG. 9) for efficient, cost effective, and convenient cooling flow.

Figure 7:
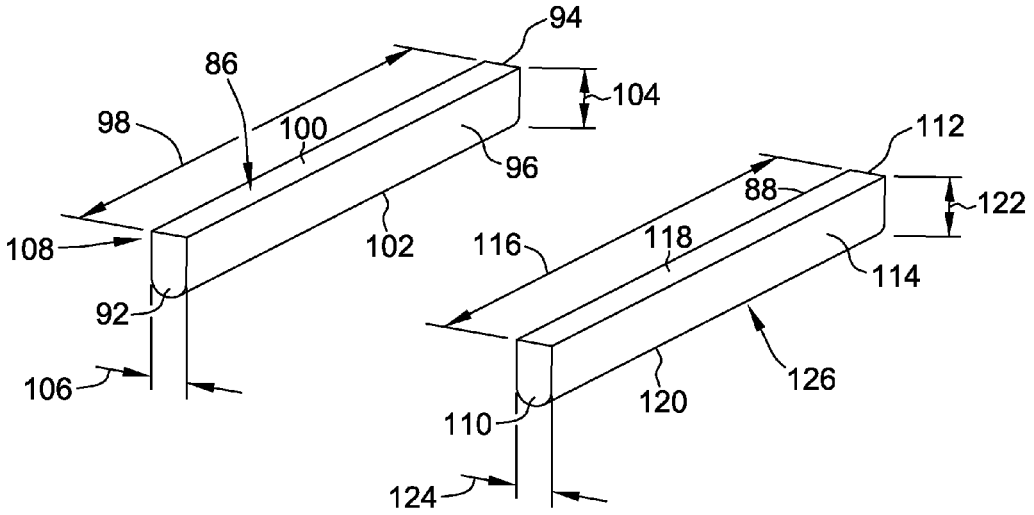
FIG. 7 is a perspective view of a first plenum member and a second plenum member of the core shown in FIG. 6.

FIG. 7 is a perspective view of first plenum member 86 and second plenum member 88 of core 42 (shown in FIG. 6). First plenum member 86 includes a first end 92, a second end 94, and a first body 96 coupled to and extending between first and second ends 92, 94. First body 96 includes a first length 98 extending between first and second ends 92, 94. Moreover, first body 96 includes a surface 100 coupled to channel members 90 (shown in FIGS. 4 and 6) and another surface 102 that extends beyond channel member 90. A first height 104 extends between surface 100 and surface 102 such that surface 102 extends beyond channel member 90. Alternatively, first height 104 may not extend beyond channel member 90. More particularly, in an alternative embodiment, first height 104 may be substantially the same as the height of channel member 90 or less than the height of channel member 90. A first width 106 extends across first end 92 and second end 94.

First end 92, second end 94, and first body 96 cooperate to define a first shape 108. In the exemplary embodiment, first shape 108 has a curvilinear shaped cross-sectional area. More particularly, first shape 108 has a U-shaped cross-sectional area. Alternatively, first shape 108 may have other shapes such as, but not limited to, square, rectangular, circular, teardrop and/or diamond shapes. First shape 108 can have any configuration that enables first plenum member 86 to function as described herein. Moreover, first shape 108 and respective cross sectional areas may vary along first length 98 of first shape 108 between first and second ends 92, 94.

Second plenum member 88 includes a first end 110, a second end 112, and a second body 114 coupled to and extending between first end 110 and second end 112. Second body 114 includes a second length 116 extending between first end 110 and second end 112. Moreover, second body 114 includes a surface 118 coupled to channel member (shown in FIGS. 4 and 5) and another surface 120 that extends beyond channel member 90 (FIG. 5). A second height 122 extends between surface 118 and surface 120 such that surface 120 extends beyond channel member 90. Alternatively, second height 122 may not extend beyond channel member 90. More particularly, in an alternative embodiment, second height 122 may be substantially the same as the height of channel member 90 or less than the height of channel member 90. A second width 124 extends across first end 110 and second end 112. In the exemplary embodiment, second length 116, second height 122, and second width 124 are substantially similar to first length 98, first height 104, and first width 106 respectively. Alternatively, second length 116, second height 122, and second width 124 may be different than first length 98, first height 104, and first width 106 respectively.

First end 110, second end 112, and second body 114 cooperate to define a second shape 126. In the exemplary embodiment, second shape 126 is substantially identical as first shape 108. Second shape 126 has a curvilinear shaped cross-sectional area, and more particularly, includes a U-shaped cross-sectional area. Alternatively, second shape 126 can be different than first shape 108. Moreover, second shape 126 can have other shapes such as, but not limited to, square, rectangular, circular, teardrop and/or diamond shapes. Second shape 126 may have any configuration that enables second plenum member 88 to function as described herein. Moreover, second shape 126 and respective cross sectional areas may vary along second length of second shape 126 between first end 110 and second end 112.

Figure 8:
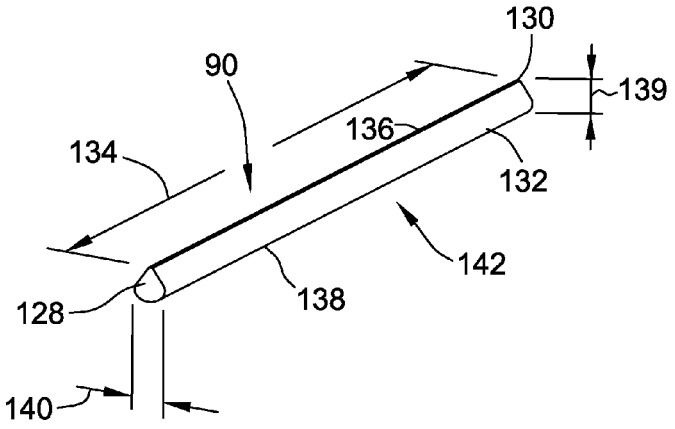
FIG. 8 is a perspective view of a channel member of the core shown in FIG. 6.

FIG. 8 is a perspective view of channel member 90 of core assembly 66 (shown in FIG. 6). In the exemplary embodiment, of channel members 90 are coupled to first plenum member 86 (shown in FIG. 6) and second plenum member 88 (shown in FIG. 6). Each channel member 90 includes a first channel end 128, a second channel end 130, and a channel body 132 coupled to and extending between first channel end 128 and second channel end 130. Channel body 132 includes a third length 134 extending between first channel end 128 and second channel end 130. Moreover, channel body 132 includes a surface 136 coupled to bottom side (shown in FIGS. 4 and 6) and another surface 138 that extends beyond bottom side 80. A third height 139 extends between surface 136 and surface 138. Still further, a third width 140 extends across first channel end 128 and second channel end 130. In the exemplary embodiment, third length 134, third height 139, and third width 140 is less than at least one of first length 98, first height 104, and first width 106 respectively and less than at least one of second length 116, second height 122, and second width 124. Alternatively, third length 134, third height 139, and third width 140 may be substantially identical as or larger than at least one of first length 98, first height 104, and first width 106 and may be substantially identical as or larger than at least one of second length 116, second height 122, and second width 124.

First channel end 128, second channel end 130, and channel body 132 cooperate to define a third shape 142. Third shape 142 has a different shaped cross-sectional area than at least one of first shape 108 and second shape 126. In the exemplary embodiment, third shape 142 has a curvilinear cross-sectional area. More particularly, third shape 142 includes a teardrop shape. Moreover, third shape 142 may have other shapes such as, but not limited to, square, circular, and diamond shapes. Alternatively, third shape 142 may have a substantially same shape as at least one of first shape 108 and second shape 126. Third shape 142 may have any configuration to enable channel member 90 to function. Moreover, third shape 142 and respective cross sectional areas may vary along third length 134 of third shape 142 between first channel end 128 and second channel end 130.

Channel member 90 is coupled to plenum members 86, 88 (shown in FIG. 6). More particularly, first channel end 128 is coupled to first plenum member 86 and second channel end 130 is coupled to second plenum member 88. Channel member 90 may couple to first plenum member 86 and/or second plenum member 88 in a non-orthogonal relationship or an orthogonal relationship. While all members 86, 88, and 90 are shown as straight and in plane with all members 86, 88, and 90 and in a parallel orientation, it should be understood that members 86, 88, and 90 could follow curved, nonlinear paths in non-parallel orientations. In alternate embodiments, first plenum member 86 and second plenum member 88 may not be used and members 90 are used to cast discrete micro channels 146 (shown in FIG. 9) independently connected to a cooling source (not shown) and independently exhausting medium 34 (shown in FIG. 1).

Figure 9:
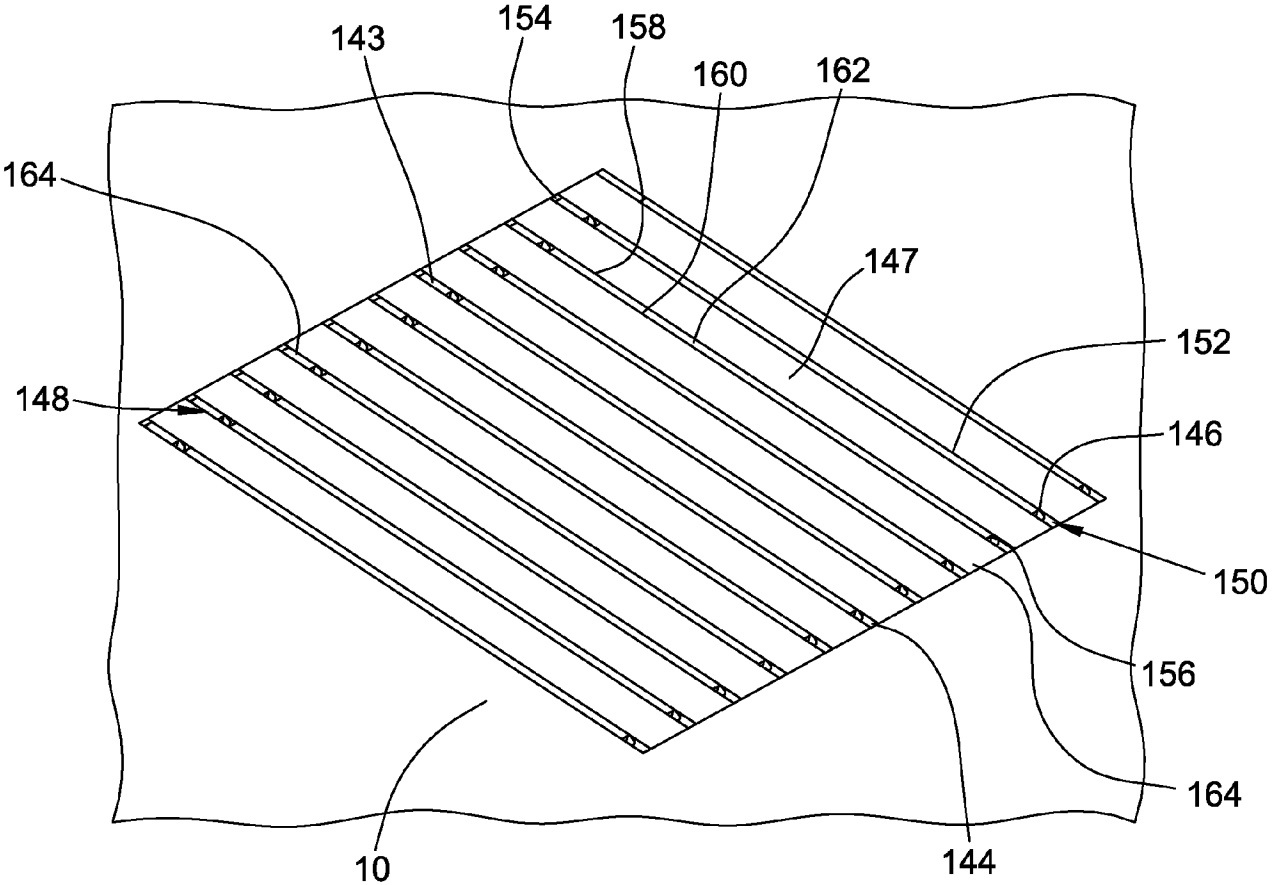
FIG. 9 is a perspective view of a first plenum, a second plenum, and a micro channel formed in the turbine component shown in FIG. 1.

FIG. 9 is a perspective view of a first plenum 143, a second plenum 144, and a micro channel 146 formed in turbine component 10 by wax tool 40 and core 42 (shown in FIGS. 3 and 6) by a casting process such as, but not limited to, an investment casting process. In the exemplary embodiment, surface areas 147 are formed between adjacent micro channels 146. First plenum 143 includes a first plenum shape 148 that is substantially similar to first shape 108 (shown in FIG. 7). Moreover, second plenum 144 includes a second plenum shape 150 that is substantially similar to second shape 126 (shown in FIG. 7). In the exemplary embodiment, first plenum 143 is coupled to a fluid source (not shown) at inlet passages 36 (shown in FIG. 1) and second plenum 144 is coupled to a discharge (not shown) at outlet passages 38 (shown in FIG. 1). Alternatively, turbine component 10 may include only a single plenum or may not include any plenums. In the exemplary embodiment, since first plenum member 86 (shown in FIGS. 5 and 6) and second plenum member 88 (shown in FIGS. 6 and 7) couple to channel members 90 (shown in FIGS. 6 and 7), first plenum 143 and second plenum 144 extend into a different plane than micro channels 146. Alternatively, first plenum 143 and second plenum 144 may be formed in the same plane as micro channels 146.

Moreover, in the exemplary embodiment, since channel members 90 extend into first plenum member 86 and second plenum member 88, micro channels 146 are configured in flow communication to first plenum 143 and second plenum 144. More particularly, since first plenum member 86 and second plenum member 88 extend beyond channel members 90, first plenum 143 and second plenum 144 are formed into turbine component 10 and below micro channel 146 while being in flow communication with micro channels 146. Alternatively, first plenum 143 and second plenum 144 can be formed in any arrangement with respect to micro channels 146. The positioning of first plenum 143, second plenum 144, and micro channels 146 facilitate enhanced cooling flow and thermal management of turbine component 10.

In the exemplary embodiment, micro channel 146 includes a third channel shape 152 that is substantially similar to third shape 142 (shown in FIG. 8). In the exemplary embodiment, third channel shape 152 includes a curvilinear shape such as, for example, a teardrop shape, wherein third channel shape 152 facilitates management of thermal and load stresses applied to turbine component 10. Micro channel 146 includes a first micro end 154, a second micro end 156, a first micro sidewall 158, and a second micro sidewall 160. First micro end 154, second micro end 156, first micro sidewall 158, and second micro sidewall 160 cooperate to define a cavity 162. More particularly, first micro end 154 is coupled in flow communication to first plenum 143 and second micro end 156 is coupled in flow communication to second plenum 144. In the exemplary embodiment, turbine component 10 includes a coating 164 that is applied around and/or in between first plenum 143, second plenum 144 and micro channel 146. Coating 164 such as, for example a thermal barrier coating, may also be applied to surface areas 147. Coating 164 is configured to form substantially smooth surfaces across surface areas 147 and across micro channels 146 and configured to provide surface protection and thermal protection for turbine component 10. Alternatively, micro channels 144 may not use a first plenum 143 and/or a second plenum 144 and may be directly connected to the fluid inflow (not shown) and outflow (not shown).

During an exemplary operation of turbine component, medium 34 (shown in FIG. 1) flows from fluid source (not shown) and into first plenum 143. Medium 34 continues to flow from first plenum 143 and into micro channels 146. More particularly, medium 34 flows from first plenum 143 and into first micro ends 154. Medium 34 flows through micro channels 146 and exits second micro ends 156. Medium 34 exhausts into second plenum 144. Second plenum 144 is configured to direct medium 34 into a discharge (not shown). Alternatively, medium 34 can flow from first plenum 143, through micro channels 146, and exhaust into a gas path (not shown) through ports such as, but not limited to, film holes and slash-face holes (not shown).

Figure 10:
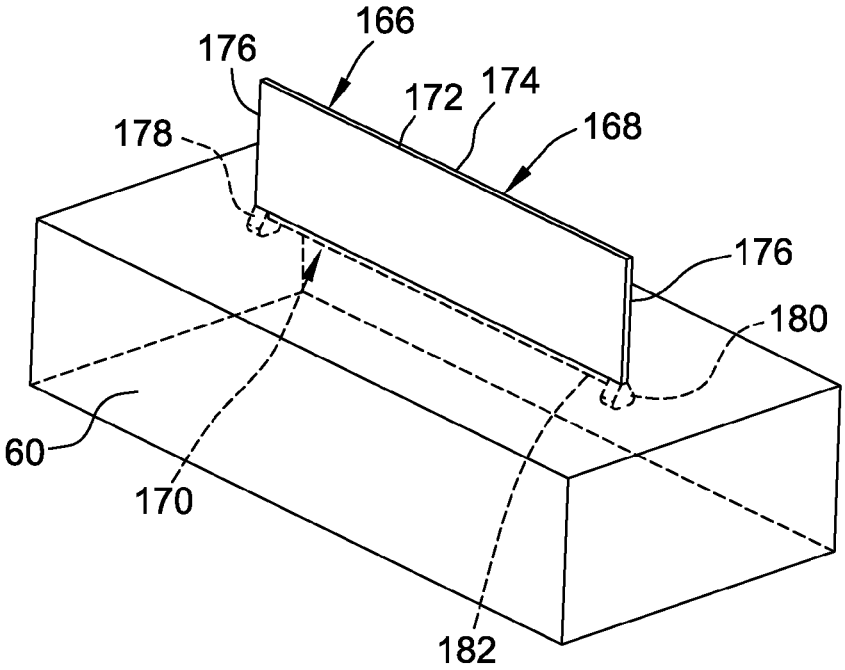
FIG. 10 is perspective view of another exemplary core that may be used with the wax tool shown in FIG. 3.

FIG. 10 is a perspective view of another exemplary core 166. Core 166 includes a base 168 and a core assembly 170, wherein, core assembly 170 is shown immersed in wax 60. Base 168 and core assembly 170 are formed from materials such as, but not limited to, ceramics materials, metallic materials, refractory materials, and alloy materials. Base 168 includes a first side 172, a second side 174, and a plurality of side walls 176 coupled to and extending between first side 172 and second side 174. In the exemplary embodiment, first side 172, second side 174, and side walls 176 cooperate to define a rectangular configuration. Alternatively, base 168 may have any configuration to enable core 166 to function as described herein.

In the exemplary embodiment, core assembly 170 is coupled to base 168. Core assembly 170 includes a first plenum member 178 and a second plenum member 180. Moreover, core assembly 170 includes a channel member 182 coupled to and extending between first plenum member 178 and second plenum member 180. Channel member 182 is coupled to second side 174 and extends away from base 168. Alternatively, plenum members 178, 180 can couple to second side 174 and extend away from base 168. In the exemplary embodiment, plenum members 178, 180 cooperate to form a triangular-shaped cross section. Moreover, channel member 182 includes a curvilinear cross section such as, but not limited to, a U-shaped cross sectional area and a teardrop cross sectional area. Moreover, cross sectional areas of core assembly 170 can vary along the length of core assembly 170. Although illustrated as straight, core assembly 170 may include a curved, non-linear configuration. First plenum member 178, second plenum member 180, and channel member 182 may have any configuration that enables core 166 to function as described herein.

Figure 11:
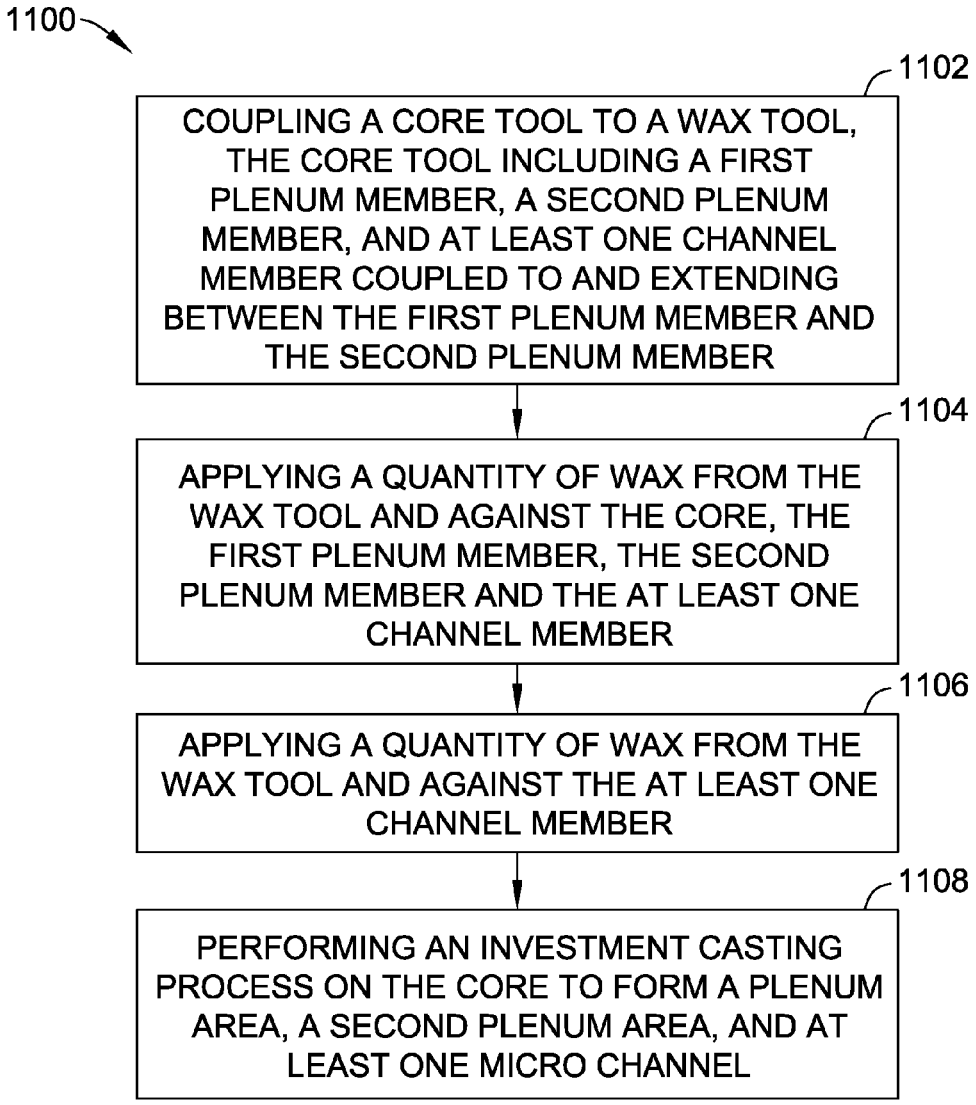
FIG. 11 is an exemplary flowchart illustrating a method of manufacturing a micro channel in a turbine component.

FIG. 11 is an exemplary flowchart illustrating an investment casting method 1100 of manufacturing a micro channel, such as micro channel 146 (shown in FIG. 9), for a turbine component, for example turbine component 10 (shown in FIG. 1). Method 1100 includes coupling 1102 a core, for example core 42 (shown in FIG. 3), to a wax tool, for example wax tool 40 (shown in FIG. 3). The core is coupled to the wax tool to position a first plenum member, a second plenum member, and a channel member, for example first plenum member 86, second plenum member 88 and channel member 90 (shown in FIG. 6), toward a wax cavity, such as wax cavity 58 (shown in FIG. 3), of the wax tool. More particularly, a first body surface, a second body surface, and a channel body surface, such as first body surface 102, second body surface 120 and channel body surface 138 (shown in FIGS. 7 and 8), are positioned within the wax cavity.

The wax tool is configured to apply 1104 a quantity of wax, for example wax 60 (shown in FIG. 3), into the wax cavity and against the core, the first plenum member, the second plenum member, and the channel member. More particularly, the wax tool is configured to apply the wax by injecting the wax against a first end, a second end, and a first body, such as first end 92, second end 94, and first body 96 (shown in FIG. 7). Moreover, the wax tool is configured to inject the wax against a first end, a second end, and a second body, such as first end 110, second end 112, and a second body 114 (shown in FIG. 7).

The wax tool is configured to apply 1106 the wax against the channel body surface. More particularly, the wax tool is configured to apply the wax by injecting the wax against a first channel end, a second channel end, and a channel body surface, for example first channel end 128, second channel end 130, and channel body 132 (shown in FIG. 8. Since the first body surface and the second body surface extend beyond the channel body surface, the first plenum and the second plenum extend into the wax beyond the micro channel to position the first plenum and the second plenum below relative to the micro channel. Moreover, since the first channel end and the second channel end are coupled to first body surface and second body surface, the micro channel is formed in flow communication with the first plenum and the second plenum.

A wax pattern is processed 1108 by a casting process, for example an investment casting process. The wax pattern and associated core is coated with a ceramic slurry (not shown) such as, for example, by dipping the wax pattern into the ceramic slurry. Method 1100 includes surface coating the wax pattern and the ceramic coating to form a ceramic shell (not shown). Investment casting process includes de-waxing (not shown) the wax pattern from the ceramic shell such as, for example, by melting the wax pattern and draining the wax pattern out of the ceramic shell (not shown) to position the core locked into the ceramic shell. The ceramic shell is heat treated (not shown). Investment casting process includes casting (not shown) a molten metal into the ceramic shell to form a turbine component, for example turbine component 10 (shown in FIG. 9). More particularly, investment casting process includes casting the molten metal to form a first plenum, a second plenum and a micro channel, such as first plenum 143, second plenum 144, and micro channel 146 (shown in FIG. 9), into the turbine component. The ceramic shell and the core are removed (not shown) to expose the turbine component. Method 1100 also includes applying a coating to the turbine component to enclose at least one of the first plenum, the second plenum, and the micro channel.

Figure 12:
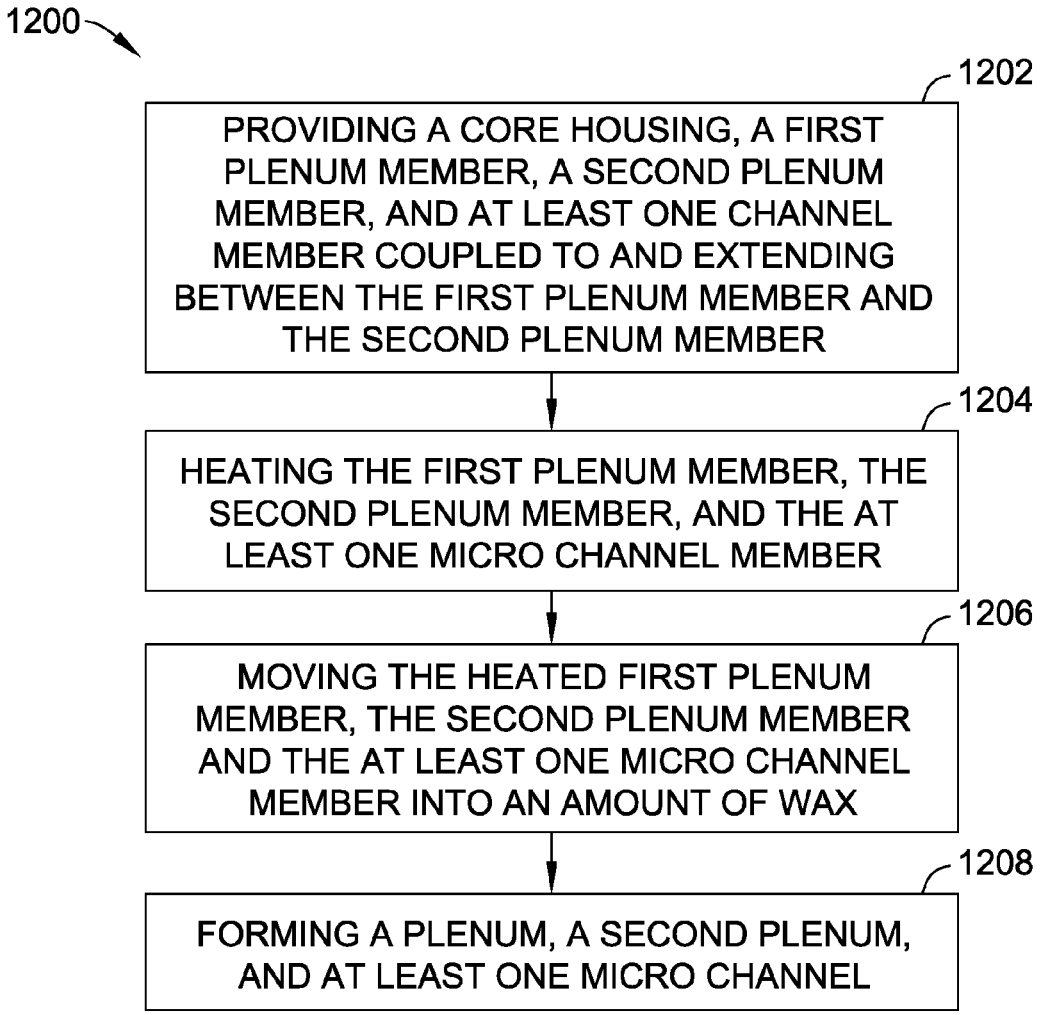
FIG. 12 is another exemplary flowchart illustrating another method of manufacturing a micro channel in a turbine component.

FIG. 12 is another exemplary flowchart illustrating an investment casting method 1200 of manufacturing a micro channel, such as micro channel 146 (shown in FIG. 9), into a turbine component, for example turbine component 10 (shown in FIG. 1). Method 1200 includes providing 1202 a core, for example core 42 (shown in FIG. 3. The core has a first plenum member, a second plenum member, and at least one channel member, such as first plenum member 86, second plenum member 88, and channel member 90 (shown in FIG. 6). Method 1200 includes heating 1204 the first plenum member, the second plenum member and the channel member. The heated first plenum member, second plenum member and the channel member are moved 1206 into an amount of wax, for example wax 60 (shown in FIG. 3) to form a wax pattern. The wax pattern is processed 1208 by a casting process, for example an investment casting process, to form a first plenum, a second plenum and a micro channel, such as first plenum 143, second plenum 144 and micro channel 146 (shown in FIG. 9), in the amount of wax.

A technical effect of the systems and methods described herein includes at least one of: (a) manufacturing a micro channel within a turbine component in a cost effective and reliable manner; (b) enables difficult areas of a turbine component to be accessed to enable the manufacture of micro channels; (c) manufacturing a micro channel in flow communication with a supply and/or exhaust plenum; (d) reducing and/or eliminating machining a micro channel into a turbine component; (e) reducing manufacturing, operating, and/or maintenance costs of a turbine component; (f) increasing an operating life of a turbine component; and, (g) enhancing cooling flow and thermal management of a turbine component.

The exemplary embodiments described herein facilitate manufacturing a micro channel within a turbine component in a cost effective and reliable manner. The embodiments described herein use a wax tool and a core that forms a micro channel within a turbine component. More particularly, the embodiments described herein enable difficult areas of a turbine component to be accessed to enable the manufacture of micro channels. Moreover, the embodiments described herein enable a micro channel to be manufactured in flow communication with a supply and/or exhaust plenum, reduce and/or eliminate machining a micro channel into a turbine component; reduce manufacturing, operating, and/or maintenance costs of a turbine component, and increase an operating life of a turbine component. The embodiments described herein form micro channels in sacrificial ceramic cores and are integral to a plate that functions at least a portion of the final surface of the airfoil, end-wall, and/or shroud being cooled. The feed and/or exhaust plenums are coupled in flow communication to the micro channels.

During the manufacturing process, the core is placed in the wax cavity and molten wax is injected around the plenums, channels, and up to the ceramic surface that defines the exterior wall of the part. In another embodiment, the core is heated and pressed into a pre-formed wax. Moreover, during the manufacturing process, once the ceramic cores are removed, the exposed micro channels and/or supply and exhaust plenums are covered by protection such as, but not limited to, sprayed coatings and pre-sintered pre-form brazed layers. The feed/exhaust plenums are integral to the channels and the airfoil/end-wall/shroud surface is left intact.

Exemplary embodiments of a micro channel wax tool, core and methods for manufacturing a micro channel are described above in detail. The methods and systems are not limited to the specific embodiments described herein, but rather, components of systems and/or steps of the methods may be utilized independently and separately from other components and/or steps described herein. For example, the methods may also be used in combination with other manufacturing systems and methods, and are not limited to practice with only the systems and methods as described herein. Rather, the exemplary embodiment can be implemented and utilized in connection with many other thermal applications. Moreover, channel member may be removably coupled to first and second plenum members to facilitate providing different channel lengths and/or heights from different channel members.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A core for forming micro channels within a turbine component, said core comprising:

a base comprising a top side and an opposite bottom side, said top and bottom sides extending between a pair of opposing side walls; and a core assembly coupled to said bottom side and comprising:

a first plenum member extending longitudinally adjacent a first of said side walls and outwardly, relative to said bottom side, to a first height; and a plurality of channel members, each of said channel members coupled to, and extending outwardly from, said bottom side to a second height that is less than said first height, each said channel member coupled to, and extending transversely from, said first plenum member, each said channel member having a channel shape configured to form the micro channels within the turbine component.

2. The core of claim 1, wherein said channel shape includes a tear drop shape.

3. The core of claim 1, wherein at least one channel member has a curvilinear cross sectional area.

4. The core of claim 1, further comprising a second plenum member coupled to said plurality of channel members opposite said first plenum member.

5. The core of claim 4, wherein said second plenum member extends longitudinally adjacent a second of said side walls.

6. The core of claim 4, wherein said second plenum member extends outwardly relative to said bottom side to a third height that is greater than said second height.

7. The core of claim 1, wherein said first plenum member comprises a first shape having a curvilinear cross sectional area.

8. The core of claim 7, wherein said first shape has a U-shaped cross sectional area.

9. The core of claim 1, wherein said channel shape has a teardrop cross-section.

10. The core of claim 9, wherein said teardrop shape extends from a narrow end coupled to said bottom surface to a free wide end away from said bottom surface.

11. A casting assembly for forming a micro channel within a turbine component, said casting assembly comprising:

a core comprising:

a base comprising a top side and an opposite bottom side, said top and bottom sides extending between a pair of opposing side walls; and a core assembly coupled to said bottom side and comprising:

at least one plenum member extending longitudinally adjacent one of said side walls and outwardly, relative to said bottom side, to a first height, said at least one plenum member having a plenum shape; and at least one channel member coupled to, and extending outwardly from, said bottom side to a second height that is less than said first height, said at least one channel member coupled to, and extending transversely from, said at least one plenum member and having a channel shape; and a wax tool coupled to said base, said wax tool comprising:

a mold portion coupled to said top side; and a wax cavity coupled to said mold portion and configured to inject a quantity of wax against said base, said at least one plenum member, and said at least one channel member.

12. The casting assembly of claim 11, wherein said at least one plenum member comprises a first plenum member and a second plenum member.

13. The casting assembly of claim 11, wherein said at least one channel comprises a first end, a second end, and a curvilinear body coupled to and extending between said first end and said second end.

14. A method of manufacturing a micro channel within a turbine component, said method comprising:

coupling a core to a wax tool that at least partially defines a wax cavity, the core comprising a first plenum member extending into the wax cavity to a first height, a second plenum member extending into the wax cavity to a second height, and at least one channel member coupled to and extending transversely between the first plenum member and the second plenum member, the at least one channel member extending into the wax cavity to a third height that is less than the first height and the second height;

applying a quantity of wax into the wax cavity and against the first plenum member, the second plenum member, and the at least one channel member; and performing an investment casting process on the core and wax to form the turbine component including a first plenum, a second plenum, and at least one micro channel corresponding respectively to the first plenum member, the second plenum member, and the at least one channel member.

15. The method of claim 14, wherein applying the quantity of wax comprises injecting the quantity of wax against the first plenum member, the second plenum member, and the at least one micro channel member.

16. The method of claim 14, comprising forming the first plenum and the second plenum to a greater depth from an outer surface of the turbine component than the at least one micro channel.

17. The method of claim 14, wherein forming the first plenum, the second plenum, and the at least one micro channel comprises forming the at least one micro channel in flow communication with the first plenum and the second plenum.

18. A turbine component comprising at least one microchannel formed by the method of claim 14.

19. A method of manufacturing a micro channel within a turbine component, said method comprising:

providing a core comprising a base, a first plenum member extending outwardly, relative to the base, to a first height, a second plenum member extending outwardly, relative to the base, to a second height, and at least one channel member extending outwardly from the base to a third height that is less than the first height and the second height, the at least one channel member coupled to and extending transversely between the first plenum member and the second plenum member;

heating the first plenum member, the second plenum member, and the at least one micro channel member;

moving the heated first plenum member, the heated second plenum member, and the at least one heated channel member into an amount of wax; and performing an investment casting process on the core and wax to form the turbine component including a first plenum, a second plenum, and at least one micro channel corresponding respectively to the first plenum member, the second plenum member, and the at least one channel member.

20. A turbine component comprising at least one microchannel formed by the method of claim 19.

* * * * *